US008534195B2

(12) United States Patent
Noll et al.

(10) Patent No.: US 8,534,195 B2
(45) Date of Patent: Sep. 17, 2013

(54) RAIL PLATE INSERTER

(75) Inventors: Donald Christopher Noll, Menomonee Falls, WI (US); Bill Luoma, Franklin, WI (US); Donald M. Treziak, Jr., Sturtevant, WI (US); Mark A. Kappel, Brookfield, WI (US); Daniel Brook, Mukwonago, WI (US)

(73) Assignee: Nordco Inc., Oak Creek, WI (US)

( * ) Notice: Subject to any disclaimer, the term of this patent is extended or adjusted under 35 U.S.C. 154(b) by 0 days.

(21) Appl. No.: 13/453,598

(22) Filed: Apr. 23, 2012

(65) Prior Publication Data

US 2012/0204753 A1 Aug. 16, 2012

Related U.S. Application Data

(62) Division of application No. 12/566,988, filed on Sep. 25, 2009, now Pat. No. 8,171,855.

(51) Int. Cl.
*E01B 3/00* (2006.01)

(52) U.S. Cl.
USPC ..... 104/16; 104/17.2

(58) Field of Classification Search
USPC ..... 104/2, 16, 17.2
See application file for complete search history.

(56) References Cited

U.S. PATENT DOCUMENTS

| | | | | | |
|---|---|---|---|---|---|
| 3,762,333 | A * | 10/1973 | Theurer et al. | 104/12 |
| 3,943,858 | A * | 3/1976 | Dieringer et al. | 104/16 |
| 4,241,663 | A * | 12/1980 | Lund et al. | 104/16 |
| 4,554,624 | A * | 11/1985 | Wickham et al. | 702/33 |
| 4,691,639 | A * | 9/1987 | Holley | 104/16 |
| 5,067,412 | A * | 11/1991 | Theurer et al. | 104/16 |
| 5,331,899 | A * | 7/1994 | Holley | 104/16 |
| 5,398,616 | A * | 3/1995 | Eidemanis et al. | 104/17.2 |
| 5,465,667 | A * | 11/1995 | Hosking et al. | 104/17.2 |
| 5,615,616 | A * | 4/1997 | Scheuchzer et al. | 104/2 |
| 5,655,455 | A * | 8/1997 | Smith | 104/16 |
| 5,671,679 | A * | 9/1997 | Straub et al. | 104/2 |
| 5,730,060 | A * | 3/1998 | Straub et al. | 104/17.2 |
| 6,595,140 | B1 * | 7/2003 | Madison et al. | 104/16 |
| 6,863,717 | B2 * | 3/2005 | Johnsen et al. | 106/6 |
| 7,497,166 | B2 * | 3/2009 | Fuerst et al. | 104/16 |
| 7,658,152 | B2 * | 2/2010 | Brenny et al. | 104/16 |
| 2007/0199473 | A1 * | 8/2007 | Fuerst et al. | 104/16 |
| 2007/0283837 | A1 * | 12/2007 | Brenny et al. | 104/16 |
| 2011/0072998 | A1 * | 3/2011 | Noll et al. | 104/16 |
| 2012/0204753 | A1 * | 8/2012 | Noll et al. | 104/16 |

* cited by examiner

*Primary Examiner* — Jason C Smith
(74) *Attorney, Agent, or Firm* — Greer, Burns & Crain, Ltd.

(57) ABSTRACT

A preferred embodiment is directed to a finger for use in a rail plate inserter machine workhead and for positioning a rail plate predisposed on a rail tie under a rail, having a planar body having an upper arm with a hook-shaped end and including an opening for accommodating a spring, the end being configured for being contacted by a bar operatively associated with a finger lift assembly; a lower arm having a depending tip; and a middle portion joining the upper and lower arms to define an obtuse angle.

6 Claims, 19 Drawing Sheets

RAIL PLATE INSERTER

This application is a divisional of application Ser. No. 12/566,988, filed Sep. 25, 2009.

BACKGROUND OF THE INVENTION

The present invention relates generally to railroad maintenance machines, and more specifically to a railway plate inserter workhead for inserting rail plates under rail ties.

Conventional railroad track consists of a plurality of spaced, parallel wooden ties to each of which are attached a pair of spaced rail tie plates. Each tie plate is configured to rest on an upper surface of the tie and includes holes for receiving fasteners such as spikes or screws, as well as a canted seat or a cradle formation for receiving the foot or base of the steel rail. Since two rails make up a railroad track, there is a pair of spaced tie plates on each tie. As is known in the art, some of the fasteners are used to secure the tie plate on the tie and others secure the base of the rail to the tie plate cradle.

When replacing worn ties, or when laying new rails on a pre-existing railroad track bed, tie plates are positioned on the railroad ties. One plate is required for each rail on a tie and the plates are initially placed adjacent the track, either by a crane or by a work gang. The plates are then non-accurately positioned upon a top surface of the tie to receive the rail.

In conventional railroad track maintenance, the plates are manually centered on the tie, then positioned under the rail to receive the foot of the rail in the recess of the plate. As part of this process, the rail is lifted from the tie to properly position the plate. It will be appreciated that such manual placement involves high labor costs, inconsistent accuracy of placement, and is time consuming.

Railways have attempted to mechanize at least portions of the plate insertion process. However, such systems have not been widely accepted by the railroads because of the relatively complicated mechanisms involved in performing the insertion. Additionally, conventional insertion machines are unable to accommodate irregularities in plate sizes and shapes. For example, plates used on curved track are larger than plates used on straight track. Deviations of as little as ⅜ of an inch in the plate are significant in automatic plate insertion machines. Due to these variations, frequent manual readjustment of settings is required in conventional plate handling equipment to accommodate different sizes and shapes of plates.

Railroad installation and maintenance machines typically include a workhead that pushes a previously placed tie plate underneath a rail tie. These conventional machines are unable to account for plates misaligned on the tie. Further, in cases where the plate inserter incorrectly pushes the plate underneath the tie, a worker is typically required to manually retrieve the plate under the tie, which is time consuming. Since plate handling machines are commonly one of a caravan of maintenance machines, the productivity of the maintenance of the railroad maintenance gang is limited as measured by the rate of the slowest unit.

Accordingly, there is a need for an improved plate inserter which reduces the manual handling of plates during the plate insertion process, and which addresses the above deficiencies of conventional plate insertion techniques and equipment.

SUMMARY OF INVENTION

Embodiments of the present invention are directed to a plate inserter workhead mounted on a moving frame that is configured for automatically squaring a plate on a tie and correctly positioning the plate under the rail. At least one of a plurality of fingers engages an opening in the tie plate and automatically pushes the plate into position. Once the plate is in position, the plate inserter workhead subsequently releases the plate. Moreover, if the plate is misaligned under the rail, the operator can retract and reinsert the plate under the rail without manual intervention from an additional worker.

More specifically, a preferred embodiment is directed to a finger for use in a rail plate inserter machine workhead and for positioning a rail plate predisposed on a rail tie under a rail, having a planar body having an upper arm with a hook-shaped end and including an opening for accommodating a spring, the end being configured for being contacted by a bar operatively associated with a finger lift assembly; a lower arm having a depending tip; and a middle portion joining the upper and lower arms to define an obtuse angle.

DETAILED DESCRIPTION OF THE EMBODIMENT

Figure 1:
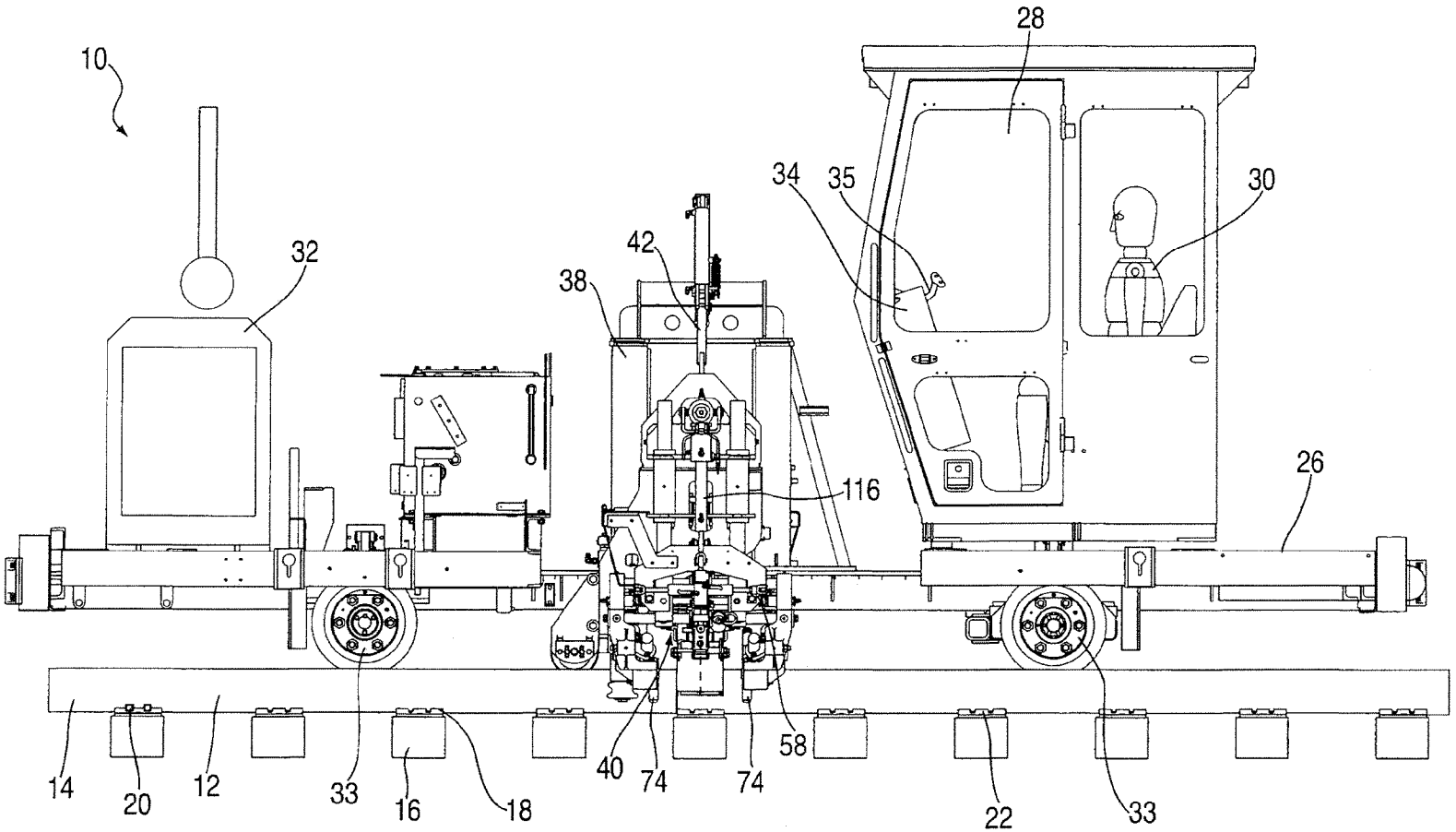
FIG. 1 is a fragmentary side view of a preferred embodiment of the present machine for inserting rail plates under rail ties.
Figure 2:
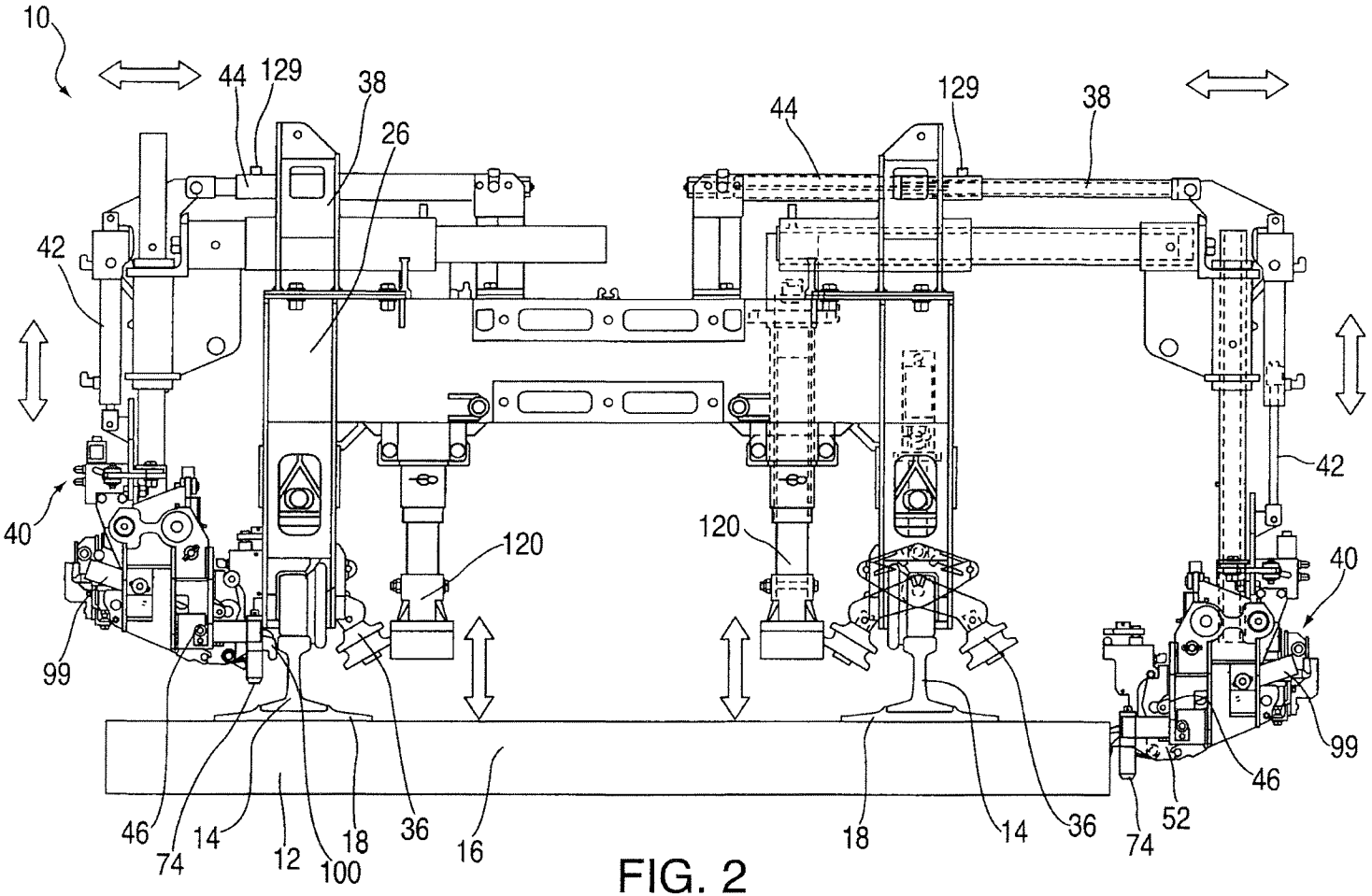
FIG. 2 is a fragmentary front view of the present machine for inserting rail plates under rail ties.

Referring now to FIGS. 1 and 2, a railway maintenance machine is generally designated 10 and moves along a railroad track 12 having two parallel rails 14. Supporting the rails 14 are a connected plurality of railroad ties 16, each positioned generally perpendicular to the rails. While wood ties are preferred, ties of other materials are also contemplated as known in the art. Preferably, a rail plate 18 is used to secure each rail 14 to the corresponding tie 16. Each rail plate 18 is secured to the tie 16 by inserting at least one rail fastener 20, such as a spike, through an opening 22 in the rail plate. Also, the tie 16 is provided with nesting recesses and formations for engaging the plate 18.

The railway maintenance machine 10 includes a frame 26 having at least one operator workstation 28 allowing an operator 30 to ride on the machine as it travels along the track 12, preferably by employing an engine 32. However, other propulsion mechanisms are contemplated. The frame 26 is provided with other components including wheels 33 for movement along the track 12. Such features are well known in the art and are disclosed in U.S. Pat. No. 5,398,616 which is incorporated by reference. At least one control system 34 is positioned near the operator workstation 28 for controlling the operation of the machine 10 as discussed below. A hydraulic remote control and a hand controller 35 is provided for operator input to the control system 34 and for moving the machine 10.

The machine 10 includes a lifter 36 for elevating the rail above the tie and at least one workhead carriage 38 which is constructed and arranged to move at least one workhead assembly 40 parallel and transverse to the rails 14. Workhead carriages 38 of this type are well known in the art (see e.g., U.S. Pat. No. 5,465,667, which is incorporated by reference). A vertical cylinder 42 on the workhead carriage 38 facilitates movement of the workhead 40 in a direction parallel to a longitudinal axis of the rail 14. A horizontal cylinder 44 on the workhead carriage 38 facilitates movement of the workhead 40 in a direction perpendicular to the longitudinal axis of the rail 14.

Figure 3:
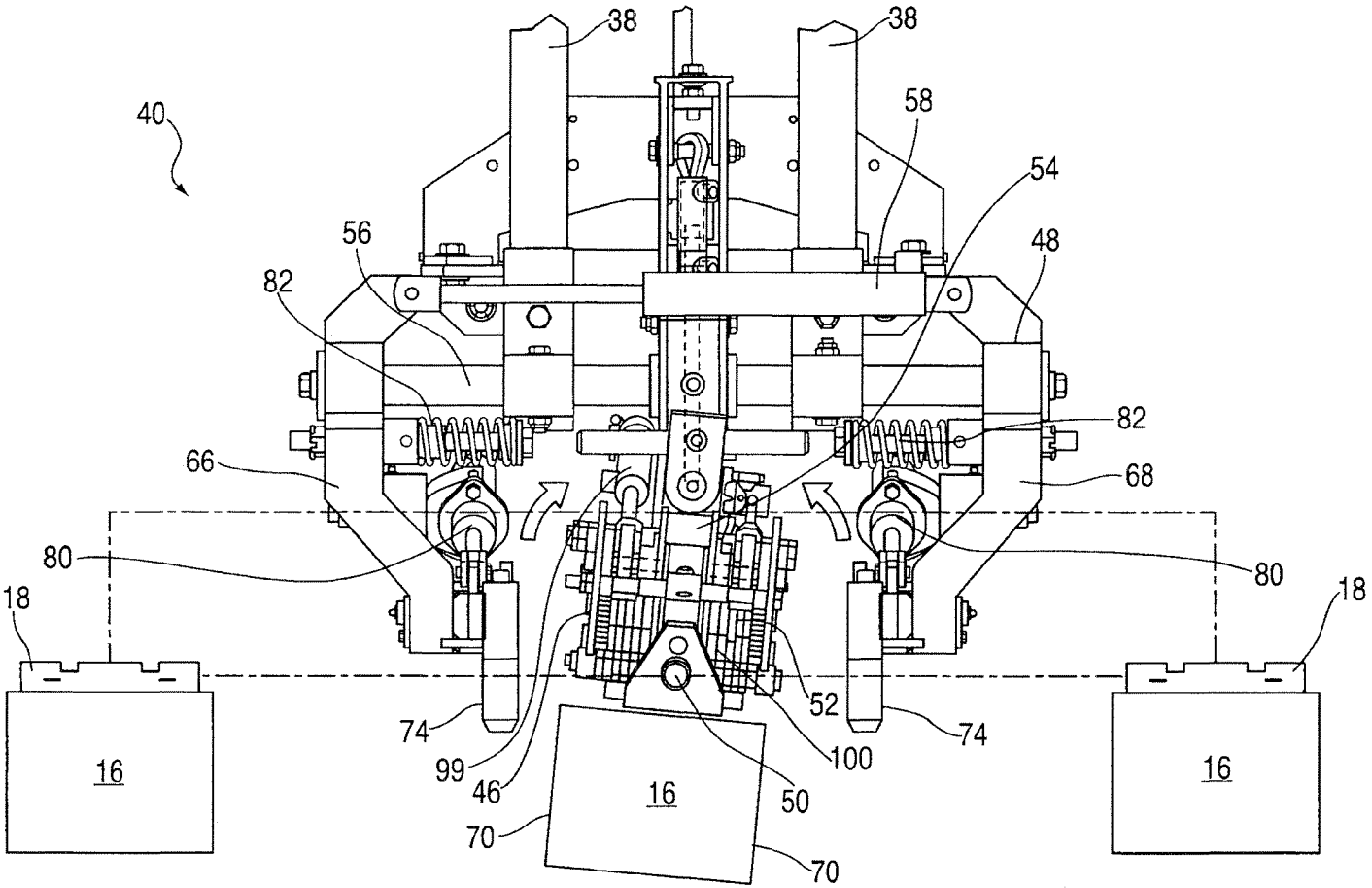
FIG. 3 is a front view of the present workhead assembly located on a side of the machine of FIG. 2.

Referring now to FIGS. 2 and 3, each workhead assembly 40 is configured to move vertically between a travel position and a ready position under the control of the control system 34. In the travel position, the vertical cylinder 42 is fully retracted to facilitate travel of the machine 10 along the track 12 and such travel is permitted by the control system 34. When in the ready position, the vertical cylinder 42 is not fully retracted, and the machine 10 is prevented from moving in either the forward and reverse direction. This feature of the present embodiment prevents possible damage to the workhead assembly 40 by not allowing the operator 30 to propel the machine 10 when the workhead is in a lowered position.

The machine 10 preferably includes two workhead assemblies 40, each being able to move independently of the other so that two rail plates 18 can be inserted simultaneously on each side of the track 14. Included in the workhead assembly 40 is a workhead body 46 connected to, among other things, a centering apparatus 48, a squaring apparatus 50 and a pusher assembly 52. Collectively, the squaring apparatus 50 and pusher assembly 52 make up a workhead center 54.

Figure 4:
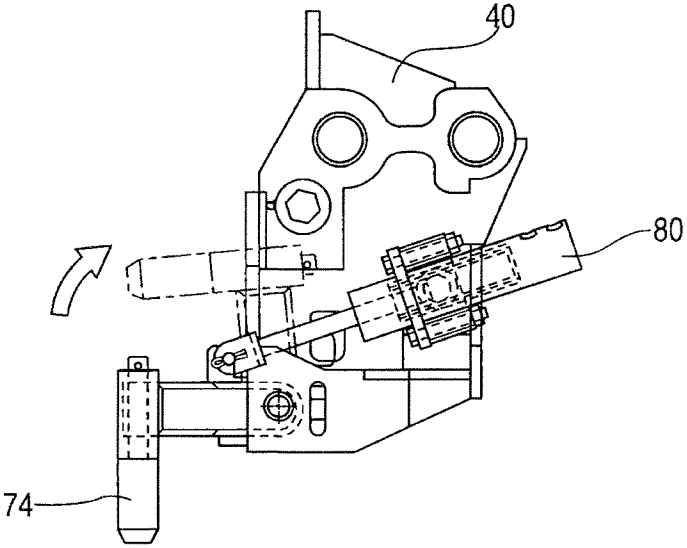
FIG. 4 is a fragmentary side view of the centering apparatus included in the workhead assembly of FIG. 3.
Figure 10:
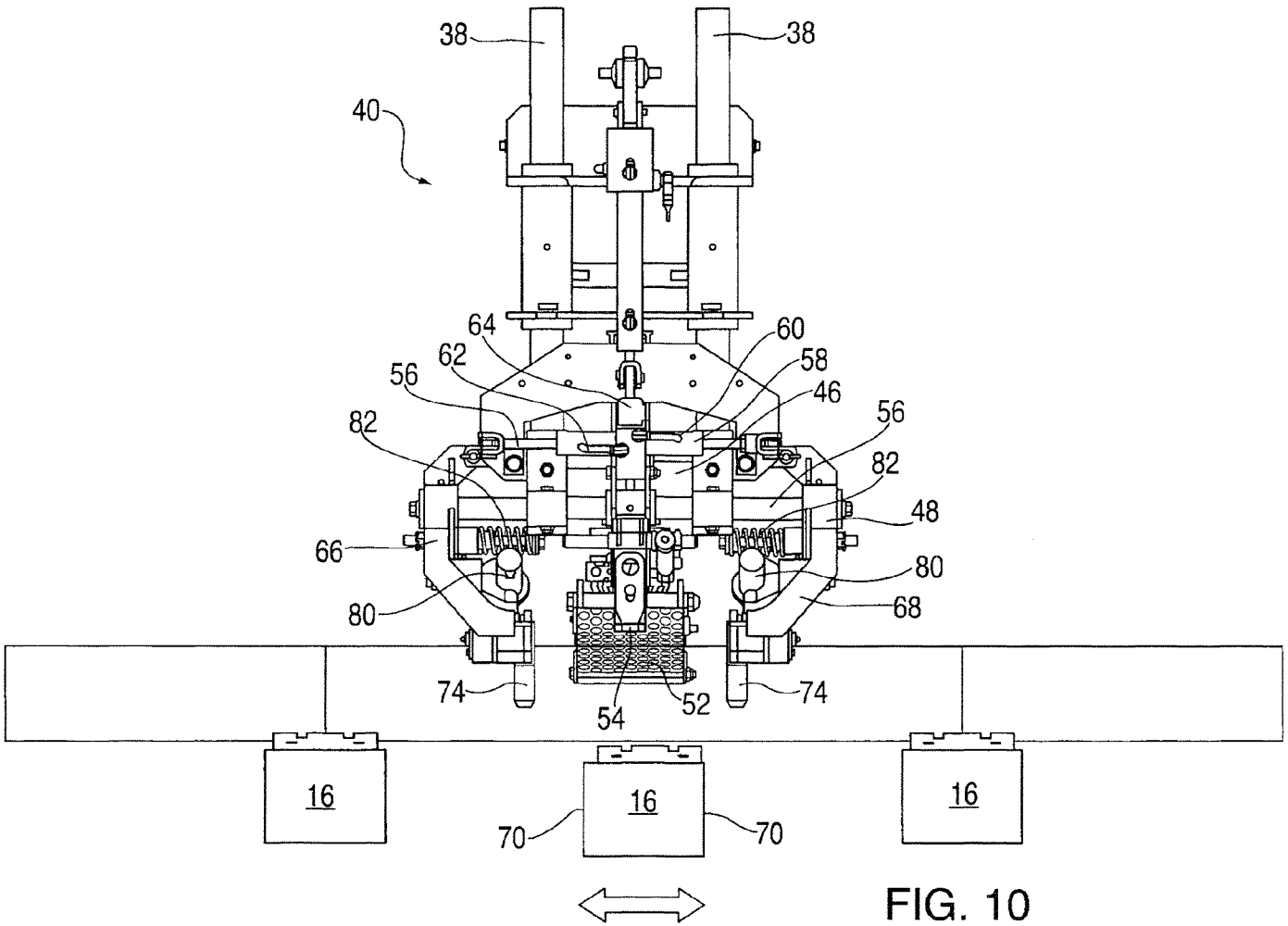
FIG. 10 is a front view of the present workhead assembly with portions removed for clarity and shown with the workhead in the ready position.

As shown in FIGS. 3-4, the centering apparatus 48 is connected to the workhead body 46 and is constructed and arranged for centering the workhead center 54 over the rail tie 16. Also, in cases where the plate 18 is misaligned on the tie 16, the centering apparatus 48 is configured to simultaneously center the workhead center 54 and the rail plate 18 on the rail tie 16. The workhead center 54 is supported on a generally horizontal shaft 56 and is movable along the shaft on the workhead assembly 40 along an axis parallel to the rails 14. In this embodiment and as best shown in FIG. 10, a double-sided cylinder 58 enables movement of the workhead center 54 along the shaft 56 by transferring hydraulic fluid between a first chamber 60 and a second chamber 62. Associated with the cylinder 58 is a lock valve 64 for preventing the flow of hydraulic fluid between the first chamber 60 and the second chamber 62. When the lock valve 64 is in a locked position, the workhead center 54 is prevented from moving along the shaft 56.

Returning to FIG. 3, a left centering element 66 and a right centering element 68 are each attached to corresponding ends of the shaft 56. Each centering element 66, 68 reciprocates laterally relative to the tie 16 and along the rail, and is operatively associated with a corresponding side 70 of the rail tie 16. Each centering element 66, 68 is also pivotable about a generally vertical axis between an open position and a closed position relative to the corresponding tie side 70. Preferably, a tie locating pin 74 for contacting a corresponding side of the rail tie 70 is included at the lower end of each centering element 66, 68.

As shown in FIGS. 3 and 4, a tie locating cylinder 80 is operatively associated with each centering element 66, 68 for moving the pins 74 from a retracted position (shown in phantom) to an extended position, thus enabling the centering elements and attached tie locating pins 74 to converge toward the rail tie 16. When the tie locating pins 74 converge against a corresponding side 70 of the rail tie 16, the workhead center 54 is forced to a position directly over the center of the tie 16. Each centering element 66, 68 is also associated with a centering element return spring 82 for moving each centering element away from the rail tie 16 after the convergence has taken place.

Now referring to FIGS. 5A-6 and 8A-B, the squaring apparatus 50 included in the workhead assembly 40 is located on the workhead body 46 and is constructed and arranged for squaring the rail plate 18 on the rail tie 16. In this configuration, the squaring apparatus 50 has a box cylinder assembly 86 mounted to the workhead body 46.

Included in the box cylinder assembly 86 is a fluid powered ram 88 reciprocating relative to the box cylinder assembly between a retracted position farthest from the rail 14 and an extended position closest to the rail. Also, the ram 88 is configured for engaging a rail plate seat 90 (see FIGS. 8A-B). Preferably, the ram 88 has hard faced edges to provide additional durability. The preferred configuration of this embodiment includes a single acting ram cylinder 92 for extending the ram 88. Also included in this embodiment is a ram return spring 94 for retracting the ram against the cylinder 92 upon depressurization. Other configurations for extending and retracting the ram 88 are also contemplated. Additionally, a tie leveling bar 96 is mounted to the box cylinder 92 for making first contact with the rail plate 18 to level the workhead body 46 with the tie 16.

The squaring apparatus 50 is configured so that when the box cylinder assembly 86 is lowered into the rail plate seat 90 (and after the workhead 54 is centered over the tie 16), the ram 88 extends to contact a front edge of the plate seat 98. This extension of the ram 88 in the plate seat 90 squares the plate 18 on the rail tie 16. Additionally, it is preferred that the squaring apparatus 50 is constructed and arranged on the workhead body 46 to operate independently of the centering apparatus 48.

Figure 6:
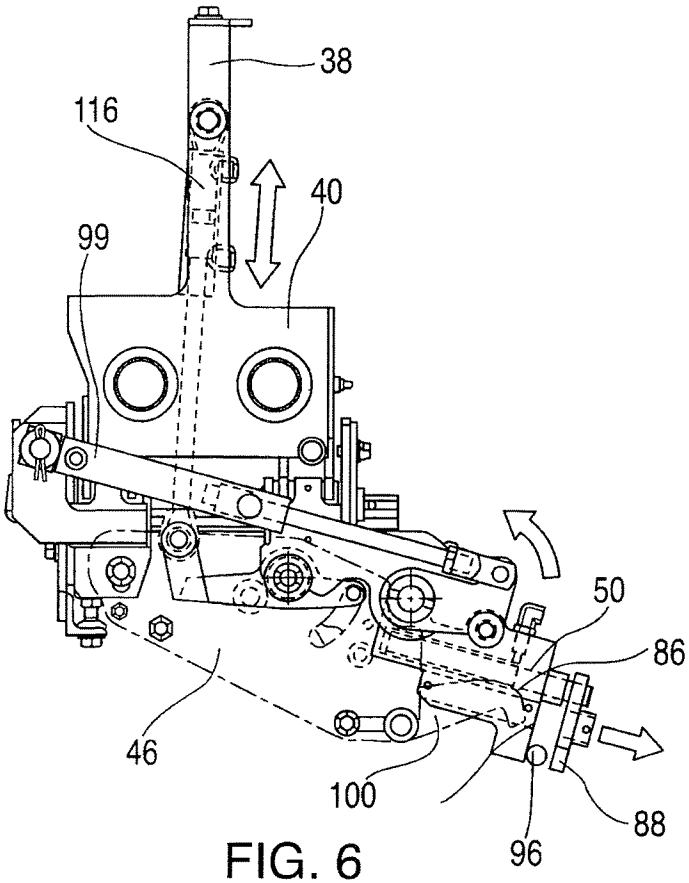
FIG. 6 is a side view of the workhead assembly of FIG. 3, depicting an opposite side from that seen in FIG. 4.

As best shown in FIG. 6, a flip cylinder 99 is also operatively connected to the box cylinder assembly 86 and centering apparatus 48 for rotating both the box cylinder assembly and the centering apparatus about a generally horizontal axis to and from the rail plate 18. As explained subsequently, such rotation is necessary during operation of the pusher assembly 52.

Referring now to FIGS. 7A-9D, the pusher assembly 52 is included on the workhead body 46 for positioning the rail plate 18 under a selected one of the rails 14 being lifted by the rail lifter 36. Included in the pusher assembly 52 is at least one plate engaging finger 100 constructed and arranged for engaging the opening 22 in the rail plate 18. Preferably, the pusher assembly 52 has a plurality of plate engaging fingers 100 divided as a right set of fingers 104 and a left set of fingers 106 spaced from the right set of fingers along an axis parallel to the rails 14. More specifically, in the preferred embodiment each set of fingers 104, 106 includes six plate engaging fingers 100. However, other configurations for the number of fingers 100 and finger sets 104, 106 are contemplated based on design preference.

Figure 7A:
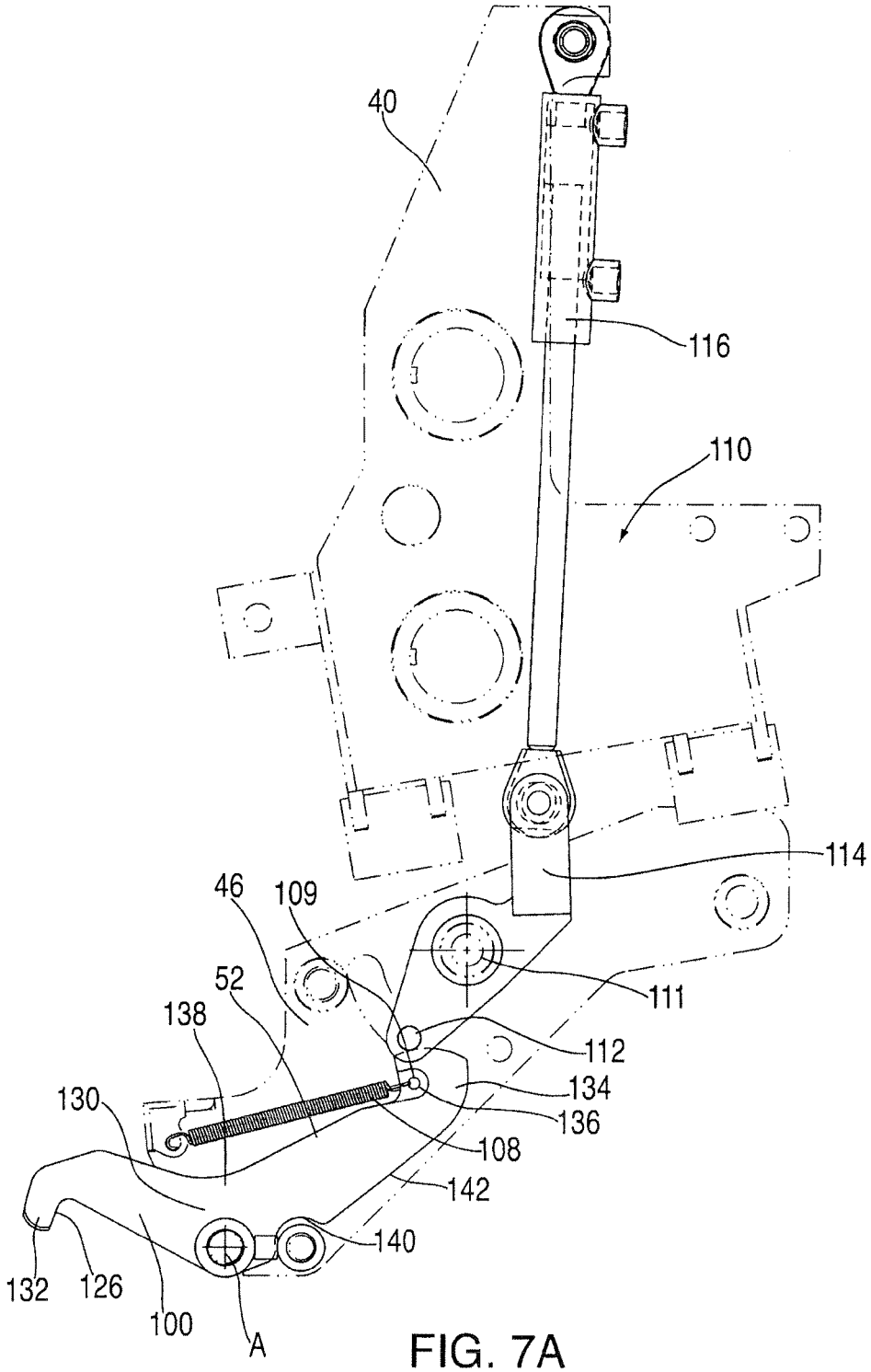
FIG. 7A is a fragmentary side view of the pusher included in the workhead assembly of FIG. 3 with the fingers in a raised position.
Figure 7B:
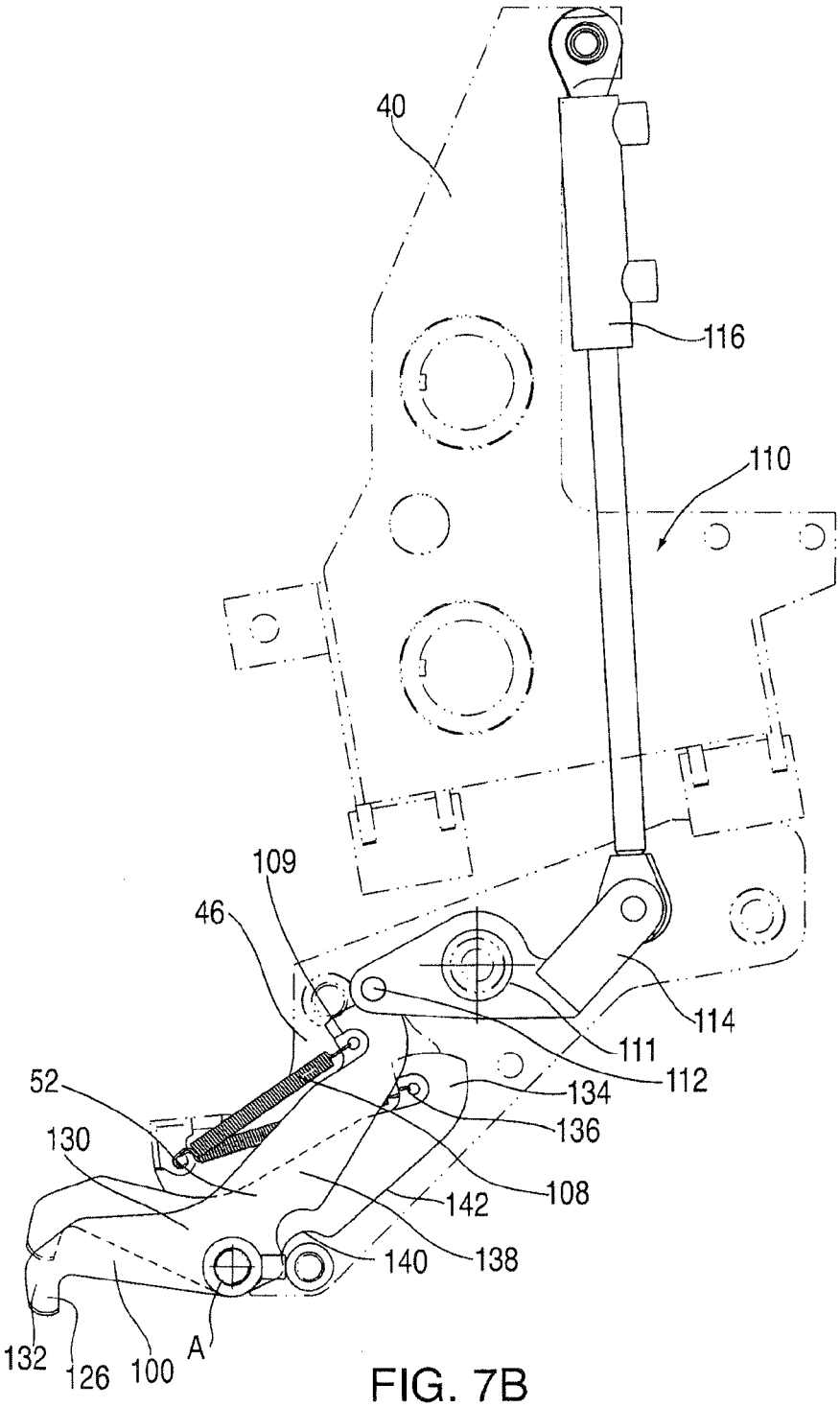
FIG. 7B is a fragmentary side view of the pusher included in the workhead assembly of FIG. 3 with the fingers in a lowered position.

As best shown in FIGS. 7A-7B, each finger 100 pivots on an axis A parallel to the rails 14. Additionally, a finger spring 108 is attached to an end of an upper arm global 109 of each finger 100. The force of the spring 108 against the finger 100 causes the finger 100 to be biased against the plate 18 so that the finger 100 engages the opening 22 in the plate 18.

A finger lift assembly 110 is provided to overcome the force of the spring 108 and raise and lower the fingers 100. Included with the finger lift assembly 110 is a cam lift 111 connected to a finger contact rod 112. The finger contact rod 112 contacts the end of the upper a in 109 of the fingers 100 to facilitate lowering and raising the fingers 100. Also included in the finger lift assembly 110 is a finger lift rocker arm 114 pivotably connected to a finger lift cylinder 116. The rocker arm 114 connects to the cam 111 such that movement of the rocker arm causes corresponding movement of the cam. Accordingly, when the finger lift cylinder 116 and rocker arm 114 are in a retracted position (FIGS. 7A and 8A), the cam 111 and attached rod 112 press down against the fingers end of the upper arm 109, causing the fingers 100 to be in a raised position. When the finger lift cylinder 116 and rocker arm 114 are in an extended position (FIGS. 7B and 8B), the rod 112 does not contact the end of the upper arm 109, and the force of the spring 108 causes the fingers 100 to be in a lowered position. As should be appreciated, the finger lift assembly 110 should be of sufficient strength to overcome the force of the spring 108.

Referring now to FIG. 10, when the workhead assembly 40 is in the ready position, using the control system 34, and preferably the hand controller 35, the operator 30 locates the workhead assembly 40 above the rail plate 18 previously displaced on the rail tie 16. While operation of the present machine 10 is described as being controlled by the operator 30, operations can also be performed automatically by the control system 34. Automatic control is preferably controlled by a program logic controller or PLC located in the control system 34, however other components providing automation are contemplated as known in the art (e.g., circuit boards and/or relays). Once in the ready position, the operator 30 can use the hand controller 35 as part of the system 34 to adjust the position of the workhead horizontal cylinder 44. Further, when in the ready position, the box cylinder assembly 86 is in the lowered position, the centering elements 66, 68 are fully open, and the tie locate pins 74 are rotated down.

Figure 11:
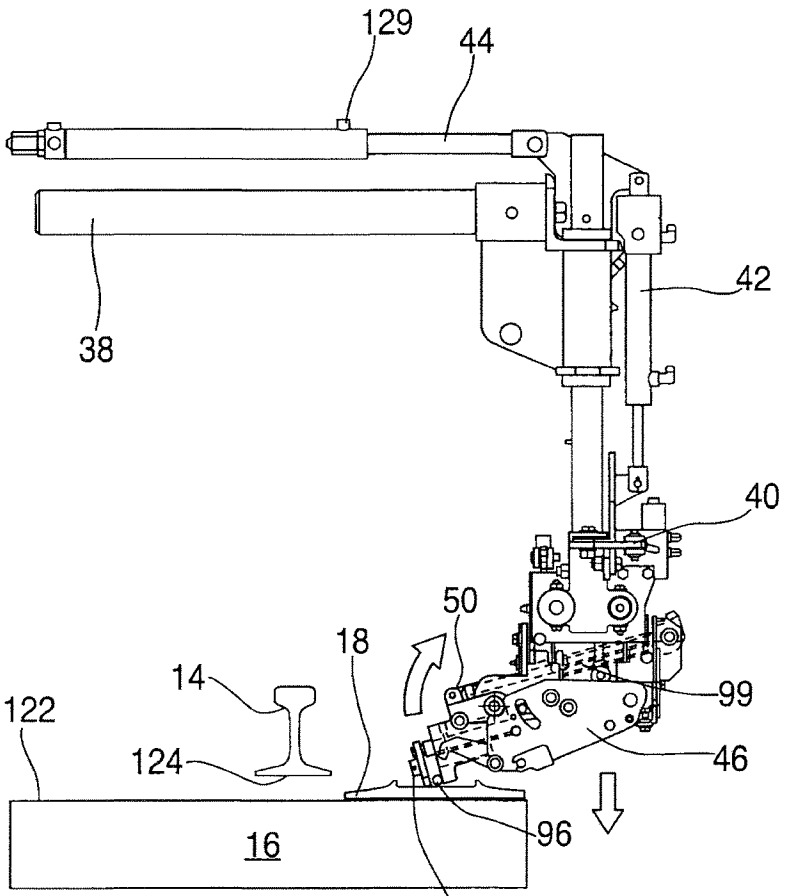
FIG. 11 is a side view of the present workhead assembly with portions removed for clarity and shown with the workhead vertical cylinder lowering the workhead body.

As best shown in FIG. 2 over the left hand rail, once the workhead assembly 40 is positioned over the rail plate 18, the operator 30 initiates the program logic to start automatic insertion of the rail plate 18 under the rail tie 16. Once the automatic insertion is started, the rail lifter 36 clamps the rail 14, and a jack cylinder 120 included in the rail lifter extends and lifts the rail a pre-determined height over a tie 16 (not shown). Referring now to FIG. 11, the pre-determined height is input from a measuring device (not shown) that calculates a gap distance between an upper surface of the tie 122 and a bottom surface of the rail 124. Next, the workhead vertical cylinder 42 lowers the workhead body 46 until contact is made between the rail plate 18 and the box cylinder assembly leveling bar 96. Once a sensor (not shown) mounted to the flip cylinder 99, and operatively connected to the box cylinder assembly 86, determines that a predetermined flip cylinder position is achieved, program logic in the control system 34 causes the vertical cylinder 42 to suspend lowering the workhead body 46.

Figure 12:
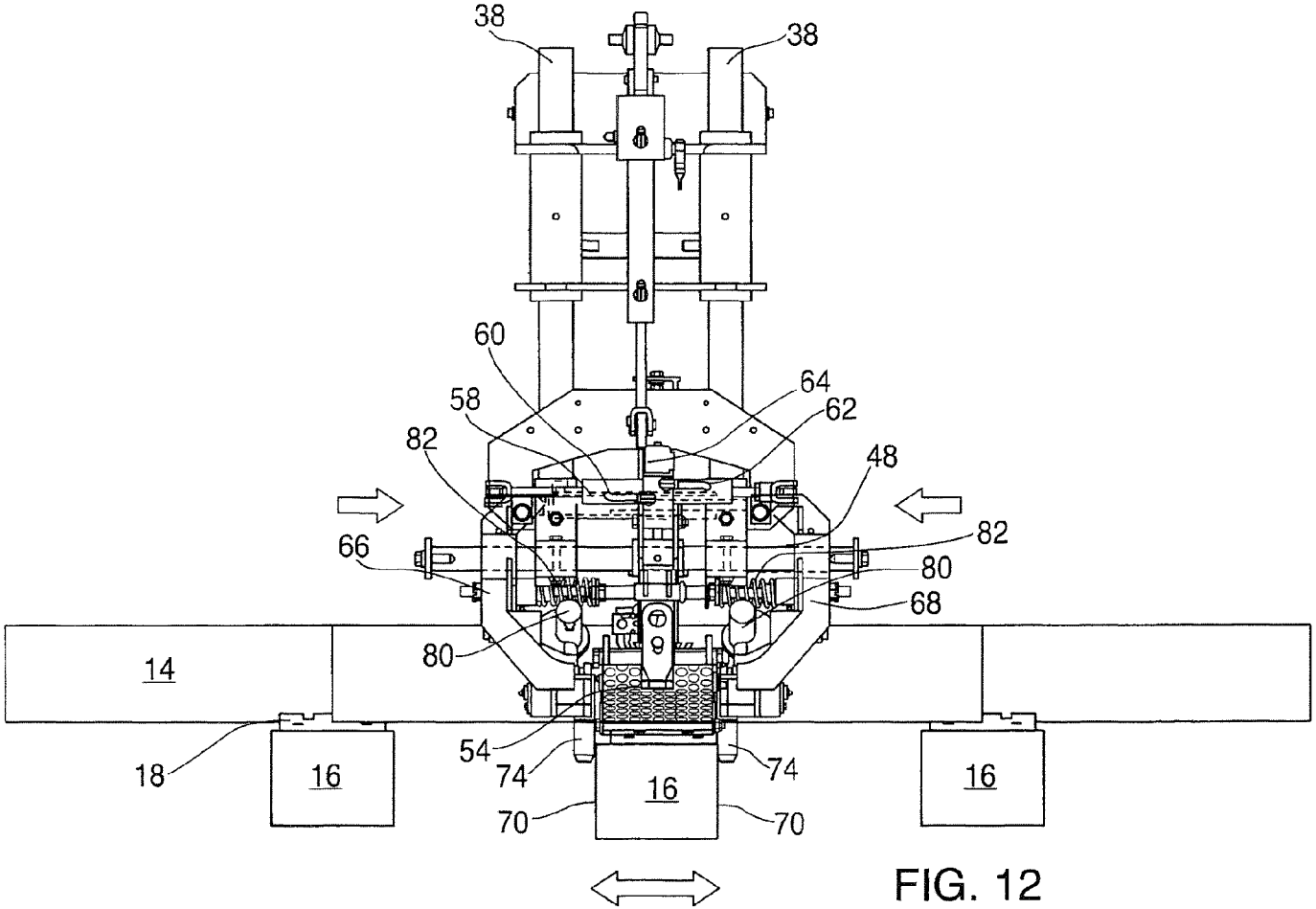
FIG. 12 is a front view of the present workhead assembly with portions removed for clarity and shown with the centering elements closed on the tie.

As best shown in FIG. 12, once lowering of the vertical cylinder 42 is halted, the lock valve 64 associated with the cylinder 58 is set to an unlock position so that the workhead center 54 is moveable along the shaft 56. At the same time, the tie locate cylinders 80 are energized, causing the tie locate elements 66, 68 and the attached tie locate pins 74 to close against the sides 70 of the rail tie 16. When the tie locating pins 74 converge on the tie 16, the workhead cylinder 58 is pressurized to force the workhead center 54 to a position directly over the center of the tie.

Figure 8A:
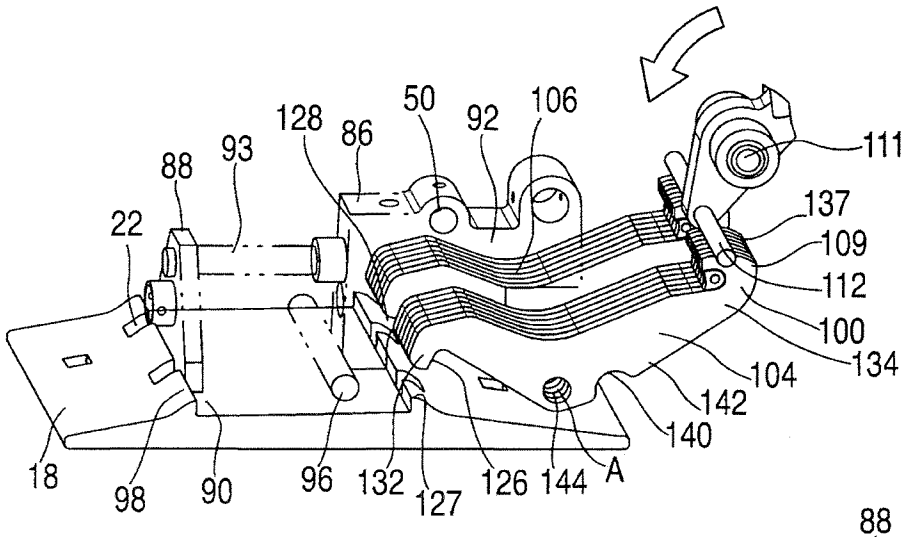
FIG. 8A is a fragmentary top perspective view of the pusher included in the workhead assembly of FIG. 3 with portions removed for clarity and shown with the fingers in a raised position.
Figure 8B:
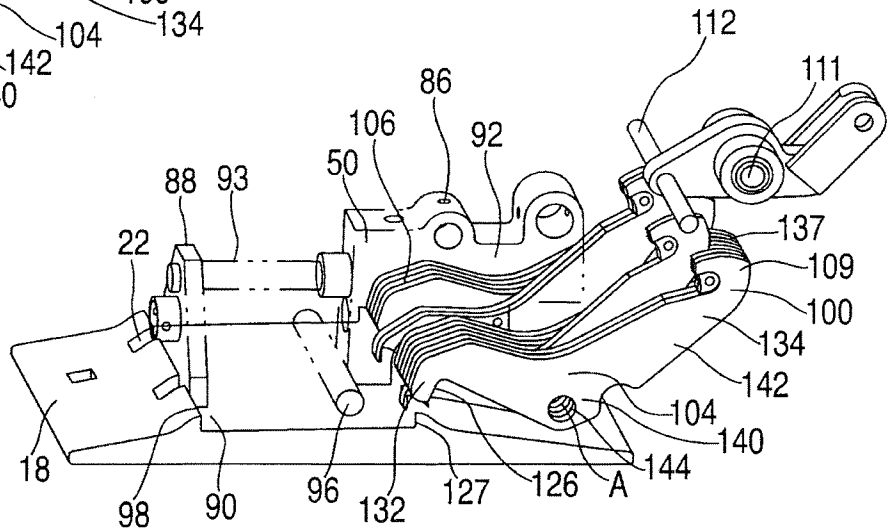
FIG. 8B is a fragmentary top perspective view of the pusher included in the workhead assembly of FIG. 3 with portions removed for clarity and shown with at least one finger engaged in an opening in the plate.
Figure 13:
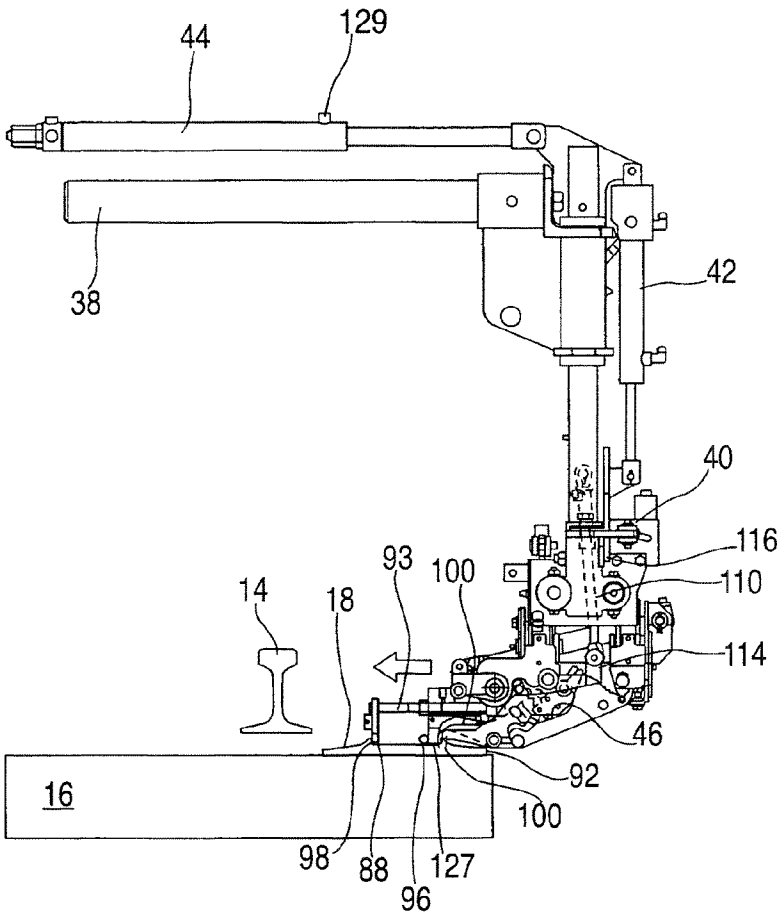
FIG. 13 is a side view of the present workhead assembly with portions removed for clarity and shown with the box cylinder extending the ram towards the rail to push the plate into position.

Referring now to FIGS. 8A-B and 13, after the workhead center 54 is centered over the tie 16, the finger lift assembly 110 is activated and the fingers 100 are lowered down against the plate 18. Next, the ram cylinder 92 extends from the box cylinder assembly 86 to force the ram 88 against the front edge of the plate seat 98. This extension of the ram 88 squares the rail plate 18 on the tie 16. At the same time, at least one of the plurality of fingers 100 engages at least one opening in the rail plate 22 while the non-engaged fingers remain pressed against the rail plate shoulder 127. Through the pressing of the fingers 100 against the rail plate shoulder 127, a vertical and horizontal force is applied against the plate 18. The vertical force component presses the rail plate 18 down while the horizontal force component forces an engaged finger back edge 126 against a rail plate opening back edge 128. Once at least one of the fingers 100 is engaged in the opening 22, the only way to free the finger from the opening is to energize the finger lift assembly 110. In the case where no finger 100 engages the opening 22, the operator 30 can stop the automated process and manually repeat the finger engagement process.

Figure 5B:
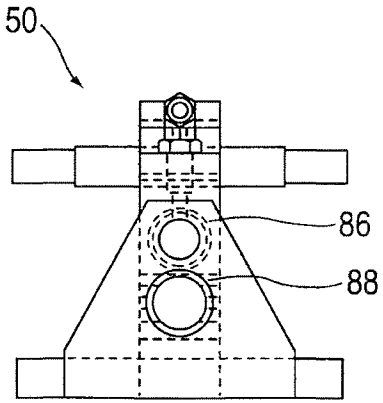
FIG. 5B is a fragmentary front view of the squaring apparatus included in the workhead assembly.
Figure 5A:
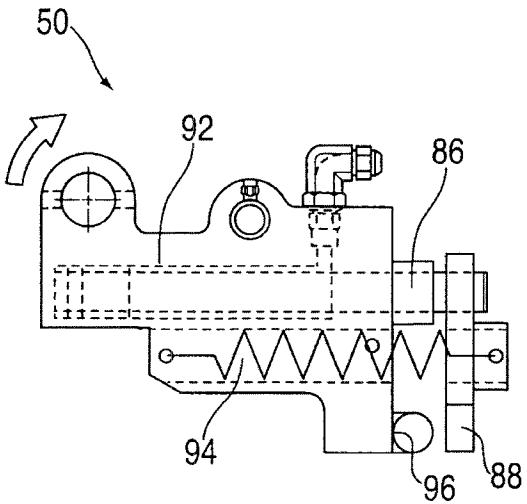
FIG. 5A is a fragmentary side view of the squaring apparatus included in the workhead assembly.
Figure 14:
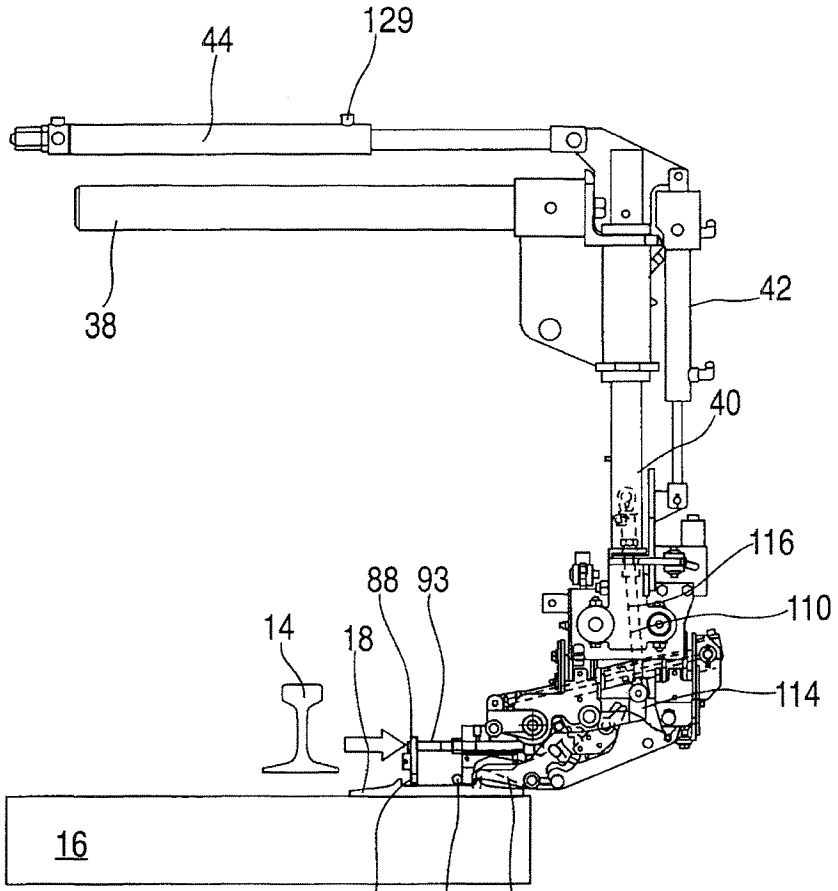
FIG. 14 is a side view of the present workhead assembly with portions removed for clarity and shown with the box cylinder retracting and at least one finger engaged in the opening in the rail plate.
Figure 15:
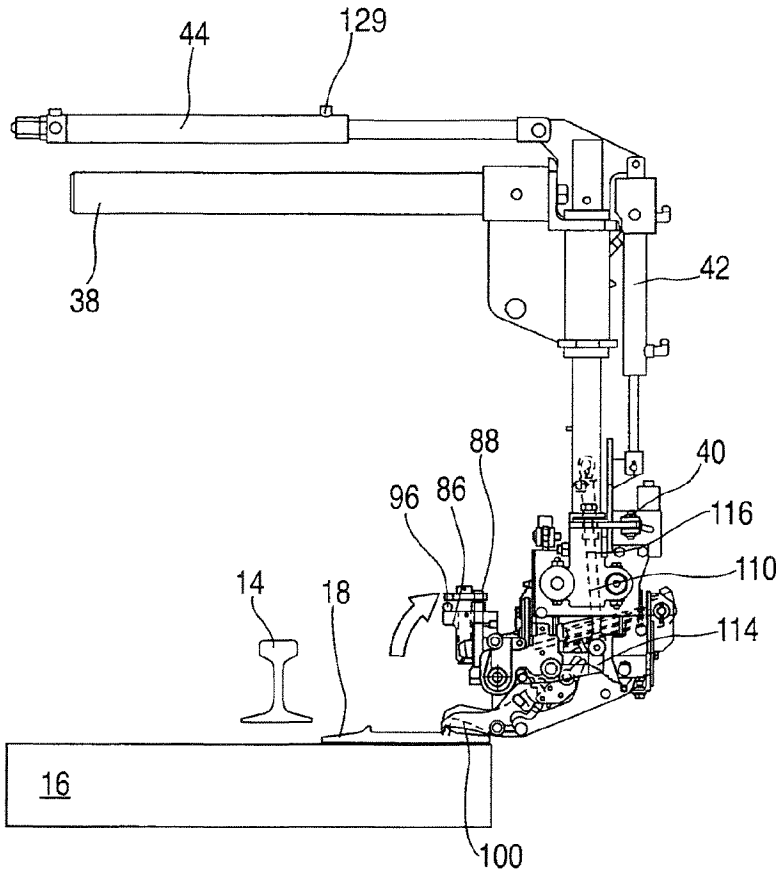
FIG. 15 is a side view of the present workhead assembly with portions removed for clarity and shown with the box cylinder assembly and tie locating pins rotated up toward the workhead body.

Moving to FIGS. 5A, 10 and 14, once the plate 18 is captured by at least one of the fingers 100, the box cylinder assembly 86 retracts the ram 88. In this embodiment, the ram cylinder 92 is depressurized and the ram return spring 94 forces the ram 88 to retract against the box cylinder 92. At the same time, the lock valve 64 associated with the shaft 58 is set to a lock position to prevent movement of the workhead center 54. As best illustrated in FIG. 10, the centering element return springs 82 return the centering elements 66, 68 to the open position so that the tie locating pins 74 are no longer adjacent to the tie sides 70. Once the centering elements 66, 68 return to the open position, the flip cylinder 99 rotates the box cylinder assembly 86 and tie locate pins 74, 76 about a horizontal axis toward the workhead body 46 and away from the rail plate 18. This rotation is best illustrated in FIG. 15.

Figure 16:
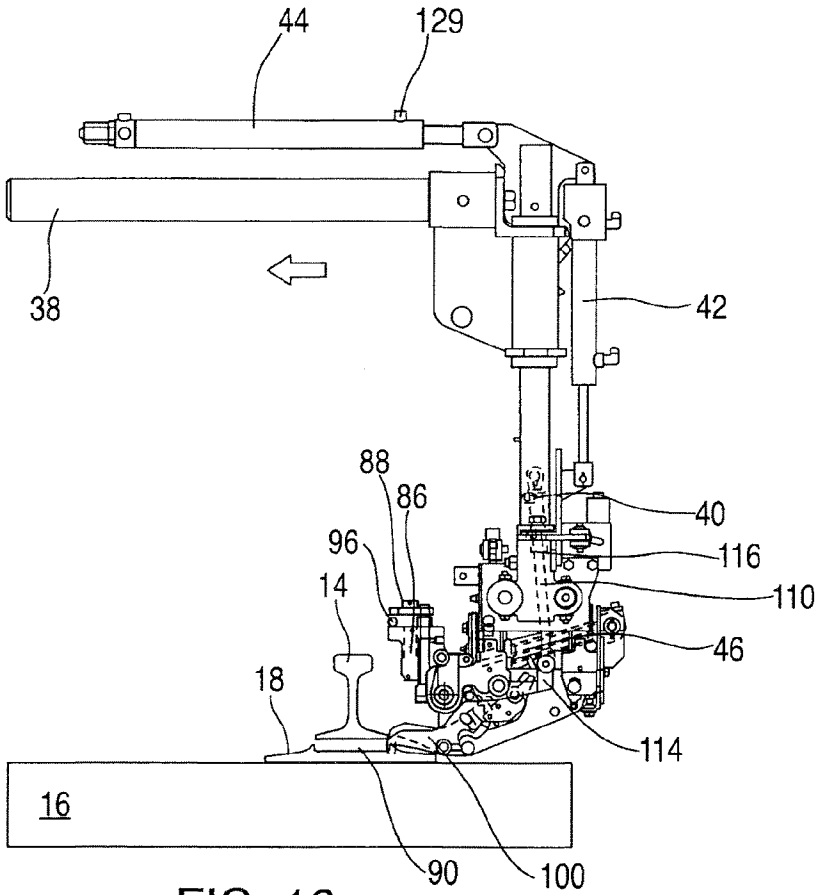
FIG. 16 is a side view of the present workhead assembly with portions removed for clarity and shown pushing the rail plate underneath the rail.

Next, as shown in FIG. 16, the workhead horizontal cylinder 44 is energized to move the workhead assembly 40 toward the rail 14, causing the engaged finger 100 to push the plate 18 underneath the lifted rail. The plate 18 is advanced underneath the rail 14 until a pressure sensor 129 located on the horizontal cylinder 44 reaches a pressure threshold. At this point, program logic stops movement of the horizontal cylinder 44 and the automatic insertion process is stopped.

Figure 17:
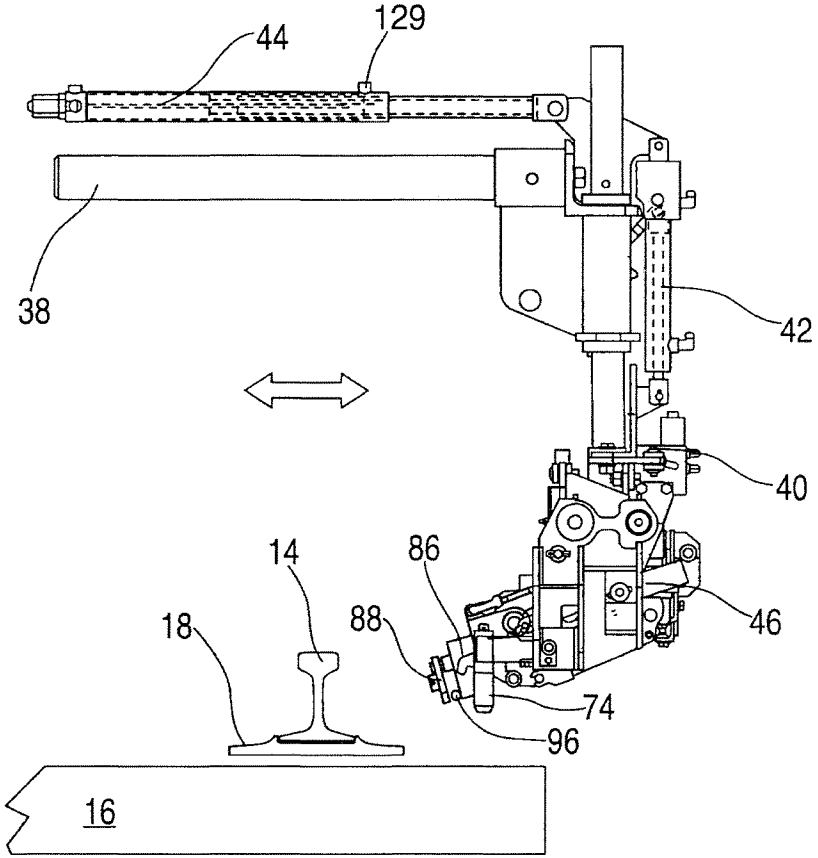
FIG. 17 is a side view of the present workhead assembly with portions removed for clarity and with the rail plate underneath the rail.

After the automatic insertion process is stopped, the operator 30 has several options. If the operator 30 is visually satisfied with insertion of the plate 18, the operator can end the cycle, and prepare the machine 10 to move to the next tie 16. A plate 18 positioned under the rail tie is shown in FIG. 17. In this event, the machine 10 will lower the rail jack 120, unclamp the rail 14, lift any engaged fingers 100 out of the rail plate opening 22 and return the workhead assembly 40 to the ready position. Alternatively, the operator 30 can choose to maneuver the rail plate 18 back out from underneath the rail 16, and reattempt the plate insertion.

Unlike conventional plate placement machines, a feature of the present machine 10 is the ability to reposition a rail plate 18 already underneath a rail 14 without intervention from an additional worker. This functionality is possible because the finger 100 is designed to engage an opening in the rail plate 22 and is reciprocally movable relative to the rail 14.

Figures 9A, 9B, 9C:
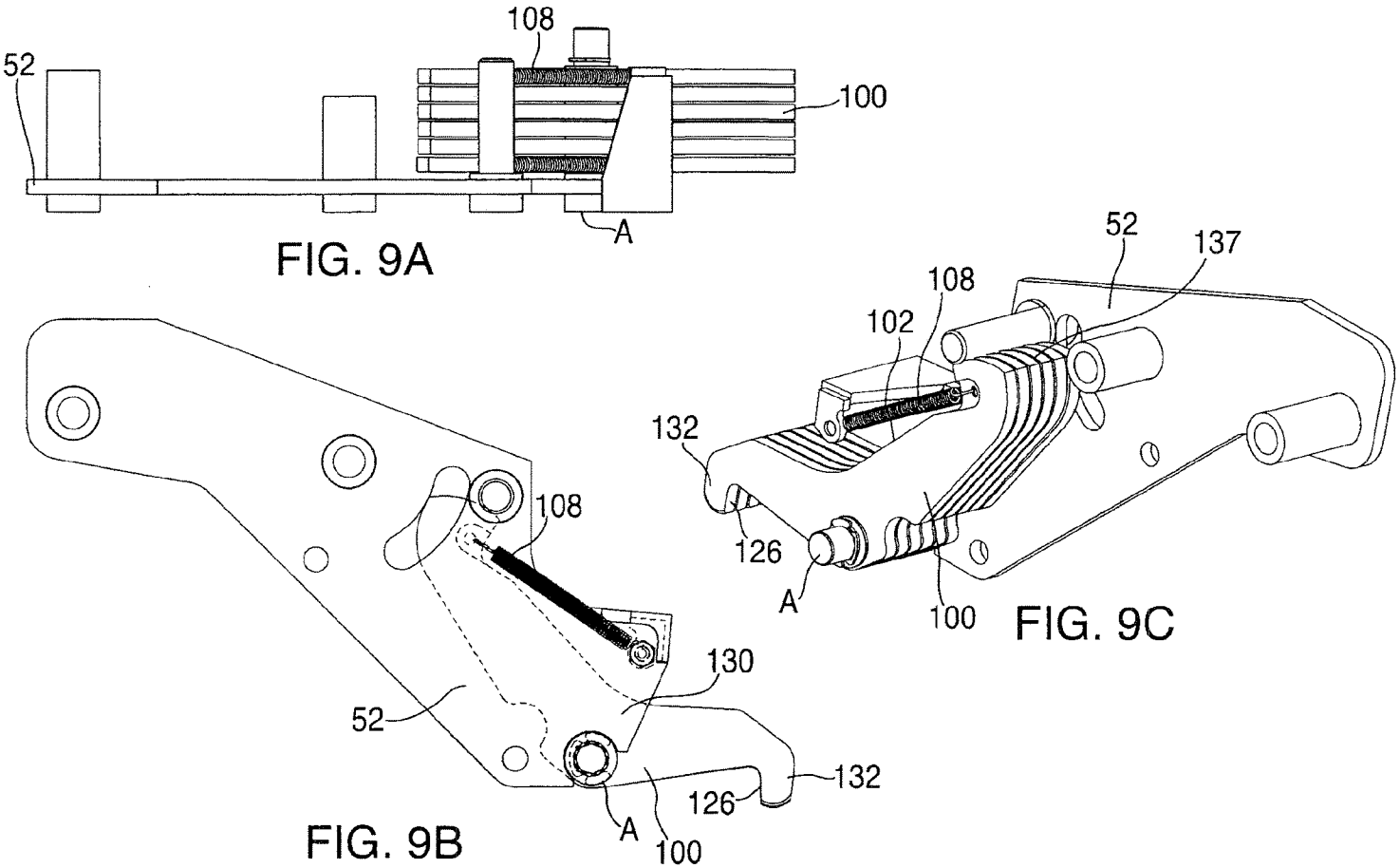
FIG. 9A is a top elevation view of the pusher assembly included in the workhead assembly of FIG. 3 with portions removed for clarity.
FIG. 9B is a side elevation view of the pusher assembly included in the workhead assembly of FIG. 3 with portions removed for clarity.
FIG. 9C is a top perspective view of the pusher assembly included in the workhead assembly of FIG. 3 with portions removed for clarity.
Figure 9D:
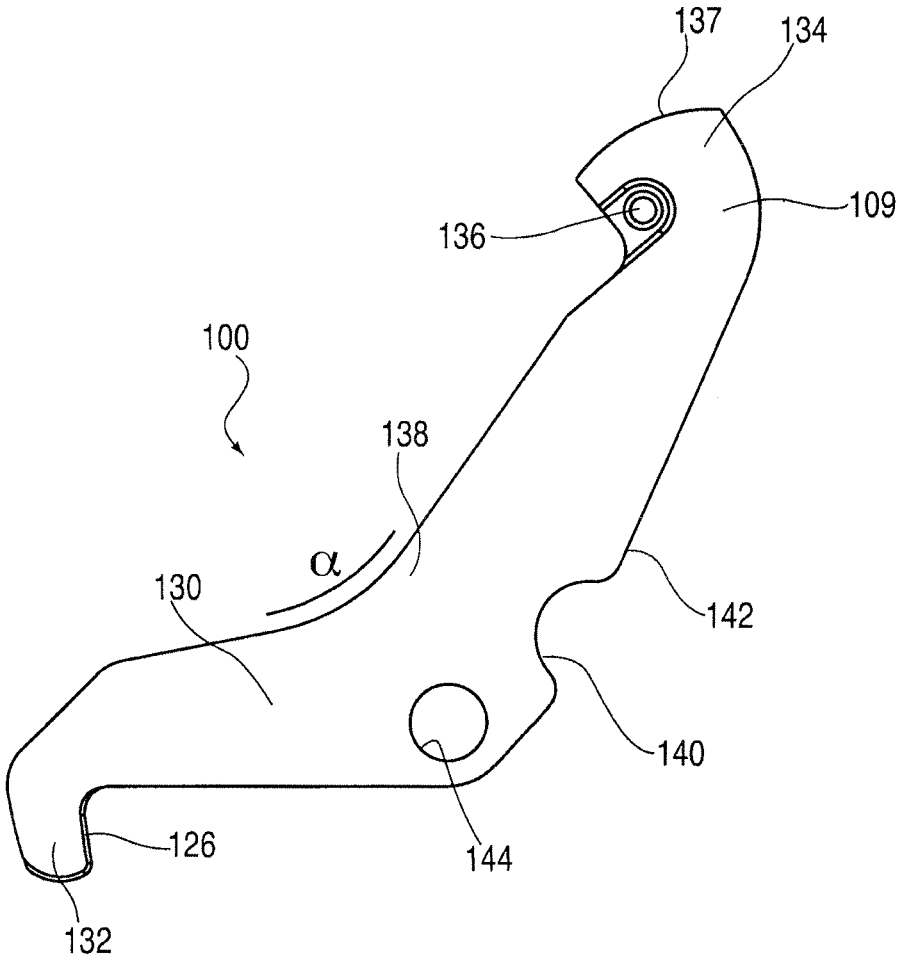
FIG. 9D is a side view of the finger included in the pusher assembly.

The finger 100 for use in the rail plate inserter machine workhead 46 and for positioning the rail plate 18 predisposed on the rail tie 16 under the rail 14 will now be described with reference to FIG. 9D. The finger 100 includes a body 101 that is preferably generally planar forming a generally boomerang or rocker shape. Included in the body 101 are the upper arm 109 and a lower arm 130 having a tip 132. Additionally, an end 134 of the upper arm 109 has a hook-shape. Also included in the upper arm 109 is an opening 136 for accommodating the spring 108. Further, the upper arm 109 is configured for being contacted by the rod 112 operatively associated with the finger lift assembly 110 (FIGS. 7A and 7B). More specifically, the upper arm 109 includes a curved surface 137 that allows the rod 112 to contact the finger 100 while minimizing wear on the rod and finger. A middle portion 138 integrally joins the upper and lower arms 109, 130. The upper and lower arms 109, 130 are angled relative to the middle portion 138 to define an obtuse angle a. The middle portion 138 preferably further includes a semi-circular recess 140 located on a bottom edge 142. Additionally, a pivot axis aperture 144 is preferably located between the upper arm 109 and the lower arm 130 to accommodate the axis A. Finally, the tip 132 depends from the lower arm 130 at an angle approximately perpendicular to the lower arm.

While particular embodiments of the present machine for inserting rail plates under a rail have been described herein, it will be appreciated by those skilled in the art that changes and modifications may be made thereto without departing from the invention in its broader aspects and as set forth in the following claims.

What is claimed:

1. A finger for use in a rail plate inserter machine workhead and for positioning a rail plate predisposed on a rail tie under a rail, comprising:

a planar body having an upper arm with a hook-shaped end and including an opening for accommodating a spring, said end being configured for being contacted by a bar operatively associated with a finger lift assembly;

a lower arm having a depending tip; and a middle portion joining said upper and lower arms to define an oblique angle, said finger is constructed and arranged for engaging an opening in the rail plate;

and wherein upon said finger being associated with the finger lift assembly, during operation, the finger lift assembly lowers a plurality of plate engaging fingers against the plate, at least one of said plurality of plate engaging fingers engages the opening in the rail plate, and as the machine workhead is moved toward the rail, said engaged fingers push the plate underneath the lifted rail.

2. The finger of claim 1 wherein said middle portion further includes a semi-circular recess located on a bottom edge.

3. The finger of claim 1 further comprising a pivot axis aperture located in said middle portion.

4. The finger of claim 3 wherein said aperture is approximately midway between said end and said tip.

5. The finger of claim 1 wherein said angle is defined by the middle portion and said arm is obtuse.

6. A finger for use in a finger lift assembly in a rail plate inserter machine workhead constructed and arranged so that, during operation, the finger lift assembly lowers a plurality of plate engaging fingers against the rail plate, the plate having a plurality of openings, at least one of the plurality of plate engaging fingers engages one of the rail plate openings, and as the machine workhead is moved toward the rail, the engaged fingers push the plate underneath the lifted rail, said finger comprising:

a planar body having an upper arm with a hook-shaped end and including an opening for accommodating a spring, said end being configured for being contacted by a bar operatively associated with a finger lift assembly;

a lower arm having a depending tip;

a middle portion joining said upper and lower arms to define an oblique angle; and said finger is constructed and arranged for engaging one of the rail plate openings.

* * * * *